US010589516B2

(12) United States Patent
Morita et al.

(10) Patent No.: US 10,589,516 B2
(45) Date of Patent: Mar. 17, 2020

(54) RECORDING APPARATUS AND RECORDING METHOD

(71) Applicant: CANON KABUSHIKI KAISHA, Tokyo (JP)

(72) Inventors: Akira Morita, Yokohama (JP); Toshimori Miyakoshi, Yokohama (JP); Takao Ogata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/882,824

(22) Filed: Jan. 29, 2018

(65) Prior Publication Data

US 2018/0215141 A1 Aug. 2, 2018

(30) Foreign Application Priority Data

Jan. 31, 2017 (JP) ..... 2017-016213

(51) Int. Cl.
*B41J 2/21* (2006.01)
*B41J 2/005* (2006.01)
*B41J 2/01* (2006.01)

(52) U.S. Cl.
CPC ..... *B41J 2/0057* (2013.01); *B41J 2/211* (2013.01); *B41J 2/2103* (2013.01); *B41J 2/2114* (2013.01); *B41J 2002/012* (2013.01)

(58) Field of Classification Search
None
See application file for complete search history.

(56) References Cited

U.S. PATENT DOCUMENTS

2011/0074893 A1* 3/2011 Sumida ..... B41J 2/17509 347/85
2013/0061767 A1* 3/2013 Casals ..... B41M 1/14 101/202
2013/0162712 A1* 6/2013 Yamanobe ..... B41J 11/002 347/16
2015/0258778 A1* 9/2015 Dooley ..... B41J 2/0057 347/103

FOREIGN PATENT DOCUMENTS

JP 2008049671 A 3/2008
JP 4834300 B2 12/2011

* cited by examiner

*Primary Examiner* — Erica S Lin
(74) *Attorney, Agent, or Firm* — Canon U.S.A., Inc. IP Division

(57) ABSTRACT

A recording apparatus includes a transfer body, an application unit configured to apply, onto the transfer body, an ink containing a color material, and a transparent transferability improving liquid for improving transferability of the ink onto a recording medium, a transfer unit configured to transfer an ink image formed on the transfer body onto the recording medium by bringing the transfer body into contact with the recording medium, a detection unit configured to detect a region in which the ink remains on the transfer body after the transfer unit transfers the ink image, and a determination unit configured to determine, based on a detection result of the detection unit, an amount of the transferability improving liquid to be applied to the transfer body by the application unit.

19 Claims, 7 Drawing Sheets

TRANSFERABILITY IMPROVING LIQUID DATA BEFORE CORRECTION

READ IMAGE

INK DATA INCLUDING COLOR MATERIAL

TRANSFERABILITY IMPROVING LIQUID DATA AFTER CORRECTION

RECORDING APPARATUS AND RECORDING METHOD

BACKGROUND

Field of the Disclosure

The present disclosure relates to a recording apparatus and a recording method for recording an image on a recording medium by transferring an ink image formed on a transfer body onto the recording medium.

Description of the Related Art

In inkjet-type image recording, bleeding, which is caused by mixing of inks applied adjacent to each other, and beading, which is caused by pulling of a previously applied ink by a subsequently applied ink, are known. Curling or cockling caused when a recording medium excessively absorbs a liquid component in ink is also known. As one of the methods for solving these problems, there is a transfer-type inkjet recording apparatus that forms an ink image on a transfer body, dries a liquid component contained in the formed ink image by means of warm air, infrared ray, or the like, and then transfers the image onto a recording medium such as paper.

On the other hand, the transfer-type inkjet recording apparatus has a problem that an image defect is caused when a part of the ink image formed on the transfer body is not transferred onto the recording medium and remains on the transfer body. As a method for solving this problem, for example, Japanese Patent No. 4834300 discusses a method for applying a first material, which contains metal salt and makes pigments of colored ink coagulate, to a transfer body before formation of an ink image, and applying a second material containing a water-soluble resin after formation of the ink image.

Furthermore, a method is known in which a pressure in a transfer process for a transfer-type inkjet recording apparatus is managed based on a distance between a main body support member and a pressing unit. In this case, if dimensional tolerances of the recording apparatus and the transfer body are taken into consideration, a variation in the pressure may occur within the surface of the transfer body. In addition, compression characteristics of the transfer body vary and degrade due to a continuous application of a pressure to the transfer body. Since the degradation of the transfer body is affected by the pressure in the transfer process, a variation may occur within the surface of the transfer body in terms of susceptibility to degradation of the transfer body. The degradation of the transfer body may cause a so-called "residual ink", which is caused when the adhesion between the ink image and the recording medium decreases in the transfer process and the ink remains on the transfer body after the transfer process. Japanese Patent Application Laid-Open No. 2008-49671 discusses a method for controlling a transfer pressure, a transfer body conveyance speed, and a transfer body temperature when a residual ink remains on a transfer body.

However, if the transfer pressure and the transfer body temperature are increased, like in the method discussed in Japanese Patent Application Laid-Open No. 2008-49671, so as to solve the problem of the residual ink, damage to the transfer body is increased and the transfer body is further degraded. If the transfer body conveyance speed is reduced, the amount of the residual ink can be reduced. However, this leads to a reduction in productivity.

SUMMARY

In view of the above-described problems, the present disclosure is directed to appropriately dealing with a case where the residual ink remains on the transfer body. According to an aspect of the present disclosure, a recording apparatus includes a transfer body, an application unit configured to apply, onto the transfer body, an ink containing a color material, and a transparent transferability improving liquid for improving transferability of the ink onto a recording medium, a transfer unit configured to transfer an ink image formed on the transfer body onto the recording medium by bringing the transfer body into contact with the recording medium, a detection unit configured to detect a region in which the ink remains on the transfer body after the transfer unit transfers the ink image, and a determination unit configured to determine, based on a detection result of the detection unit, an amount of the transferability improving liquid to be applied to the transfer body by the application unit.

Further features of the present disclosure will become apparent from the following description of exemplary embodiments with reference to the attached drawings.

DESCRIPTION OF THE EMBODIMENTS

Preferred exemplary embodiments of the present disclosure will be described in detail below.

(Transfer-Type Inkjet Recording Apparatus)

Figure 1:
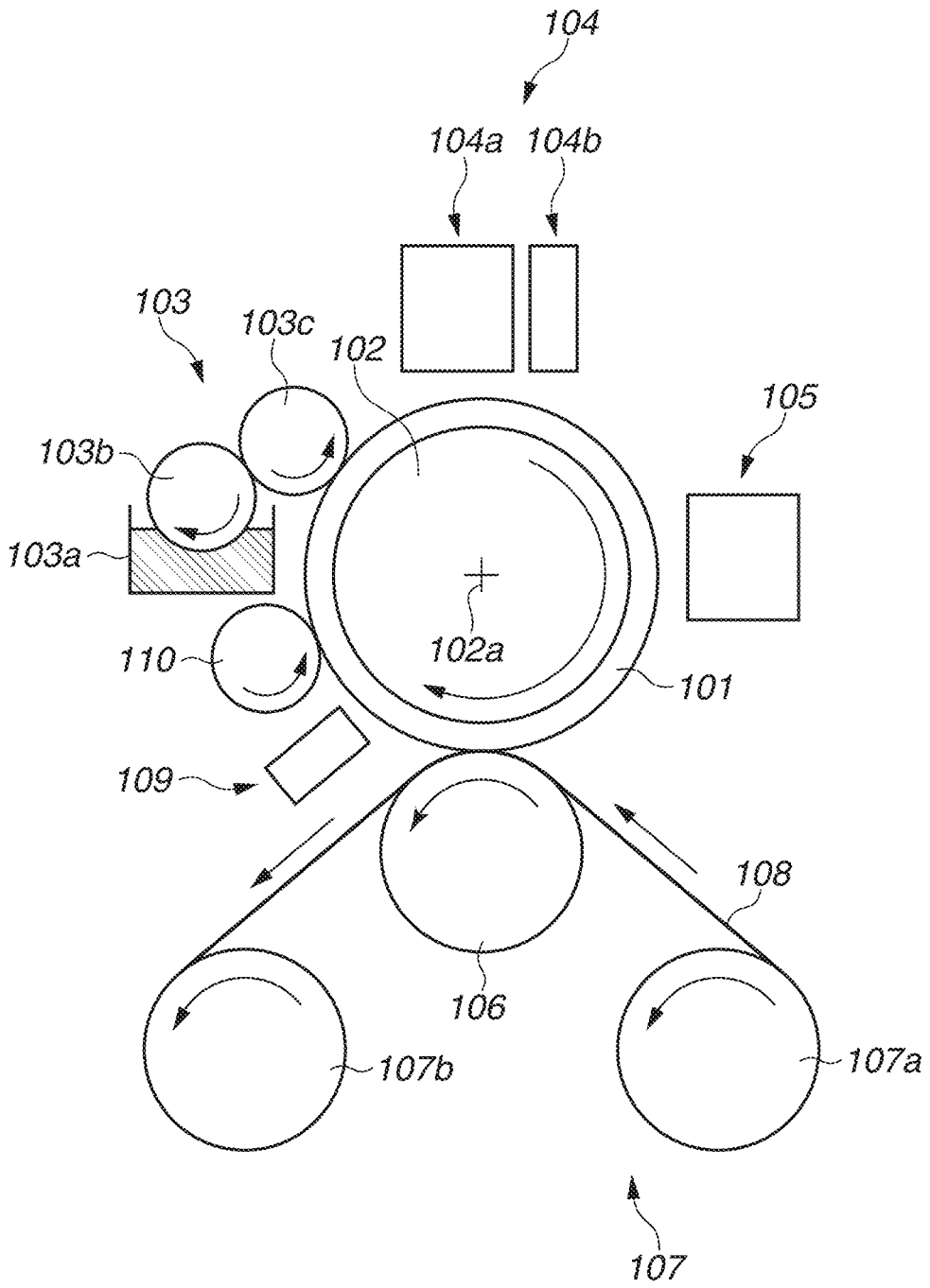
FIG. 1 is a schematic diagram illustrating a schematic configuration of a transfer-type inkjet recording apparatus, according to one or more embodiment(s) of the subject disclosure.

FIG. 1 is a schematic diagram illustrating a schematic configuration of a transfer-type inkjet recording apparatus according to an exemplary embodiment of the present disclosure. The transfer-type inkjet recording apparatus includes the following configuration. A transfer body 101 is supported by a cylindrical support member 102 and is continuously or intermittently provided on an outer peripheral surface of the support member 102. A reaction liquid application unit 103 applies a reaction liquid onto the transfer body 101. An ink application unit 104 applies a transferability improving liquid and an ink containing a color material onto the transfer body 101 onto which the reaction liquid has been applied, so that an ink image is formed on the transfer body 101. A liquid removal unit 105 removes a liquid component from the ink image formed on the transfer body 101. A transfer unit 106 transfers the ink image, which is formed on the transfer body 101 and from which the liquid component is removed, onto a recording medium 108 such as paper. An image reading unit 109 reads the surface of the transfer body 101 after a transfer process, thereby checking whether a residual ink remains on the transfer body 101. A transfer body cleaning unit 110 cleans the surface of the transfer body 101 after the transfer process.

The support member 102 is rotated in a direction indicated by an arrow in FIG. 1 about a rotation axis 102*a*. The rotation of the support member 102 causes the transfer body 101 to move cyclically on a circular orbit. The application of the reaction liquid by the reaction liquid application unit 103 and the application of the ink by the ink application unit 104 are sequentially performed on the moved transfer body 101, thereby forming the ink image on the transfer body 101. The ink image formed on the transfer body 101 is moved to a position corresponding to the liquid removal unit 105 by the movement of the transfer body 101, and processing for removing the liquid component from the ink image is carried out. The ink image from which the liquid component is removed is moved to a position corresponding to the transfer unit 106 by the movement of the transfer body 101. The ink image formed on the transfer body 101 is pressed against the recording medium 108, which has been conveyed to the position corresponding to the transfer unit 106 by a recording medium conveyance unit 107, so that an image is formed on the recording medium 108. After the ink image is transferred, the image reading unit 109 reads the surface of the transfer body 101, and outputs read image data obtained after reading the surface of the transfer body 101 to a printer control unit 203 which is described below.

Each component of the transfer-type inkjet recording apparatus described above will be described in more detail.

<Transfer Body>

The transfer body 101 may be formed of a single layer, or a laminate of a plurality of layers. In a case where the transfer body 101 is formed of a plurality of layers, the plurality of layers may include three layers, for example, a surface layer, an elastic layer, and a compressive layer. The surface layer is an outermost layer having an image formation surface on which the ink image is formed. Because the compressive layer is provided, the compressive layer can absorb deformation, distribute local pressure fluctuations, and maintain the transferability also during high-speed printing. The elastic layer is a layer formed between the surface layer and the compressive layer.

As a material for the surface layer, various materials such as resins and ceramics can be used as needed. A material having a high compressive elastic modulus can be used in terms of durability or the like. Specific examples of the material include acrylic resin, acrylic silicone resin, fluorine-containing resin, and a condensate prepared by condensation of a hydrolyzable organic silicon compound. In order to improve the wettability, the transferability, and the like, of a reaction liquid, a surface treatment may be performed on the surface layer. Examples of the surface treatment include flame treatment, corona treatment, plasma treatment, polishing treatment, roughening treatment, active energy ray-irradiation treatment, ozone treatment, surfactant treatment, and silane coupling treatment. These treatments may be performed in combination. The surface layer may have any surface shape.

Examples of the material for the compressible layer include acrylonitrile-butadiene rubber, acrylic rubber, chloroprene rubber, urethane rubber, and silicone rubber. When the rubber material as described above is molded, predetermined amounts of a vulcanizing agent, a vulcanization accelerator, and the like may be added, and a foaming agent, hollow fine particles, or a filler such as sodium chloride may be further added, as needed, to form a porous rubber material. Because of the porous rubber material, bubble portions are compressed with volume changes against various pressure fluctuations, and thus deformation except in a compression direction is small, so that more stable transferability and durability can be achieved. Examples of the porous rubber material include a material having a continuous pore structure in which pores are continuous with each other and a material having a closed pore structure in which pores are independent of each other. In the present exemplary embodiment, either of the structures may be used, or the structures may be used in combination.

As the material for the elastic layer, various materials such as resins and ceramics can be appropriately used. From the viewpoint of processing characteristics and the like, various elastomer materials and rubber materials may be used. Specific examples include fluorosilicone rubber, phenylsilicone rubber, fluororubber, chloroprene rubber, urethane rubber, nitrile rubber, ethylene-propylene rubber, natural rubber, styrene rubber, isoprene rubber, butadiene rubber, ethylene/propylene/butadiene copolymers, and nitrile-butadiene rubber. In particular, silicone rubber, fluorosilicone rubber, and phenylsilicone rubber, which have a small compress set, are favorable from the viewpoint of dimensional stability and durability. The change in elastic modulus of such materials due to a temperature is small, and thus the above-described materials are favorable also from the viewpoint of transferability.

Between the surface layer and the elastic layer, and between the elastic layer and the compressible layer, various adhesives or double-sided adhesive tapes may be used to fix and hold the layers. The transfer body may also include a reinforcing layer having a high compressive elastic modulus to suppress lateral elongation when installed in an apparatus, or to maintain resilience. A woven fabric may be used as the reinforcing layer. The transfer body 101 can be prepared by combination of any layers made of the above-described materials.

The size of the transfer body 101 can be freely selected depending on the intended size of an image to be recorded. The shape of the transfer body is not particularly limited and is specifically exemplified by a sheet shape, a roller shape, a belt shape, and an endless web shape. In the present exemplary embodiment, a plurality of transfer bodies 101 each having a finite strip shape is arranged.

The layers, of which each transfer body 101 is formed, have an in-plane variation of several μm to several tens of μm in the thickness direction due to a preparation accuracy or the like, and the transfer bodies 101 have individual differences. Accordingly, in a case where the distance between the main body support member and the pressing unit is controlled to change the amount of compression in the thickness direction of the transfer body so as to apply a pressure, the pressure on the surface of each transfer body 101 varies within the surface of the transfer body 101. Since the deterioration rate of the transfer body 101 itself varies depending on the magnitude of the pressure to be applied to the transfer body 101, the deterioration rate in a portion to which a large pressure is applied is high. Accordingly, not only the thickness of the transfer body 101 itself, but also the degree of progress in degradation of the transfer body 101 varies within the surface of the transfer body 101.

<Support Member>

The transfer body 101 to be used in the present exemplary embodiment is supported on the support member 102. As the method of supporting the transfer body 101, various adhesives or double-sided adhesive tapes may be used. Alternatively, by attaching an installing member made of a metal, ceramics, a resin, or the like may be attached to the transfer body 101 so that the transfer body 101 may be supported on the support member 102 by using the installing member.

The support member 102 is required to have a certain structural strength from the viewpoint of conveyance accuracy and durability. As the material for the support member 102, metals, ceramics, resins, and the like can be used. In particular, aluminum, iron, stainless steel, acetal resins, epoxy resins, polyimide, polyethylene, polyethylene terephthalate, nylon, polyurethane, silica ceramics, and alumina ceramics can be used in terms of the rigidity capable of withstanding the pressure at the time of transfer, dimensional accuracy, and reduction of the inertia during operation to improve the control responsivity. These materials may be used in combination.

<Reaction Liquid Application Unit>

The reaction liquid application unit 103 includes a reaction liquid containing unit 103*a* that contains the reaction liquid, and reaction liquid application members 103*b* and 103*c* that apply the reaction liquid contained in the reaction liquid containing unit 103*a* onto the transfer body 101. In the present exemplary embodiment, various known devices for applying the reaction liquid can be used as needed. Specific examples include a gravure offset roller such as the reaction liquid application unit 103 illustrated in FIG. 1, an inkjet head, die coating, and blade coating. The reaction liquid has a function of increasing the viscosity of ink when the reaction liquid comes into contact with the ink to be applied to the transfer body 101 after the reaction liquid is applied to the transfer body 101.

<Reaction Liquid>

The reaction liquid according to the present exemplary embodiment contains a component that increases the viscosity of ink. The increase in viscosity of the ink is such a phenomenon that when a color material, a resin, or the like as a component of the ink comes into contact with an ink-viscosity-increasing component, the components are chemically reacted or physically adsorbed, and this causes an increase in viscosity of the ink. The increase in viscosity of the ink includes not only an increase in viscosity of the entire ink, but also a local increase in viscosity due to aggregation of some of the components of the ink, such as a color material. The ink-viscosity-increasing component has the effect of lowering the flowability of the ink and/or some of the components of the ink on a recording medium to suppress bleeding or beading at the time of image formation. In the present exemplary embodiment, as such an ink-viscosity-increasing component, known materials such as polyvalent metal ions, organic acids, cation polymers, and porous fine particles can be used. In particular, polyvalent metal ions and organic acids are preferred. A plurality of types of ink-viscosity-increasing components can also be preferably contained. The content of the ink-viscosity-increasing component in the reaction liquid is preferably 5% by mass or more relative to the total mass of the reaction liquid. Examples of the polyvalent metal ions include divalent metal ions such as $Ca^{2+}$, $Cu^{2+}$, $Ni^{2+}$, $Mg^{2+}$, $Sr^{2+}$, $Ba^{2+}$, and $Zn^{2+}$, and trivalent metal ions such as $Fe^{3+}$, $Cr^{3+}$, $Y^{3+}$, and $Al^{3+}$. Examples of the organic acids include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, and dioxysuccinic acid.

The reaction liquid may contain an appropriate amount of water or organic solvent. The water used in this case is preferably a deionized water prepared by, for example, ion exchanging. The organic solvent that can be used for the reaction liquid applied in the present exemplary embodiment is not particularly limited, and a known organic solvent can be used.

A surfactant or a viscosity modifier can be added to the reaction liquid to appropriately adjust the surface tension or the viscosity thereof. The material to be used may be any material that can coexist with the ink-viscosity-increasing component. The surfactant specifically used is exemplified by an acetylene glycol ethylene oxide adduct ("Acetylenol E100", manufactured by Kawaken Fine Chemicals Co., Ltd.) and a perfluoroalkyl ethylene oxide adduct ("MEGAFACE F444", manufactured by DIC Corporation).

<Ink Application Unit>

In the present exemplary embodiment, an ink jet head is used as the ink application unit 104 for applying the ink and the transferability improving liquid to form an ink image on the transfer body 101. Examples of the ink jet head include a head that causes film boiling of ink by an electricity-heat transducer to form bubbles and discharges the ink, a head that discharges ink by an electricity-machine transducer, and a head that discharges ink by using static electricity. The head using an electricity-heat transducer can be used from the viewpoint of high-density printing at a high speed. The head receives an image signal and applies a necessary amount of ink to each position, thereby forming an ink image on the transfer body 101.

The ink application amount can be expressed by an image density (duty) or an ink thickness. In the present exemplary embodiment, the mass of each ink dot is multiplied by the number of dots applied, and the result is divided by a printed area to give an average as the ink application amount ($g/m^2$).

The ink application unit 104 includes an ink application unit 104*a* for applying an ink containing a color material onto the transfer body 101, and a transferability improving liquid application unit 104*b* for applying the transferability improving liquid. The ink application unit 104 according to the present exemplary embodiment can apply three colors of ink, i.e., a cyan ink (C), a magenta ink (M), and a yellow ink (Y), in addition to a black ink (K), and includes inkjet heads for the respective ink colors. The inkjet heads are each provided with a plurality of recording element arrays in which recording elements for discharging the ink are arranged. One inkjet head may include one recording element array corresponding to each color of the four colors of ink, or may include a plurality of recording element arrays for each one of the colors of ink. Similarly, the transferability improving liquid application unit 104*b* may have a configuration in which each inkjet head includes one or more recording element arrays, or the transferability improving liquid application unit 104*b* may include a plurality of inkjet heads.

<Ink>

Each component of an ink containing a color material used in the present exemplary embodiment will be described. The ink used in the present exemplary embodiment contains color materials corresponding to C, M, Y, and K, respectively, and is a colored ink used to form an ink image on the transfer body 101.

(Color Material)

In the present exemplary embodiment, a pigment or a mixture of a dye and a pigment can be used as the color material of ink. The type of the pigment that can be used as the color material is not particularly limited. Specific examples of the pigment include inorganic pigments such as carbon black, and organic pigments such as azo pigments, phthalocyanine pigments, quinacridone pigments, isoindolinone pigments, imidazolone pigments, diketopyrrolopyrrole pigments, and dioxazine pigments. These pigments can be used singly or in combination of two or more of them as needed. The type of the dye that can be used as the color material is not particularly limited. Specific examples of the dye include direct dyes, acid dyes, basic dyes, disperse dyes, and food dyes, and a dye having an anionic group can be used. Specific examples of the dye skeleton include an azo skeleton, a triphenylmethane skeleton, a phthalocyanine skeleton, an azaphthalocyanine skeleton, a xanthene skeleton, and an anthrapyridone skeleton. The content of the pigment in the ink is preferably 0.5% by mass or more to 15.0% by mass or less and more preferably 1.0% by mass or more to 10.0% by mass or less relative to the total mass of the ink.

(Dispersant)

As the dispersant for dispersing a pigment, a known dispersant used in an inkjet recording method can be used. Specifically, a water-soluble dispersant having both a hydrophilic moiety and a hydrophobic moiety in the structure is preferably used in the present exemplary embodiment. In particular, a pigment dispersant composed of a resin prepared by copolymerizing a mixture containing at least a hydrophilic monomer and a hydrophobic monomer is preferably used. Each monomer used herein is not particularly limited. Specific examples of the hydrophobic monomer include styrene, styrene derivatives, alkyl (meth)acrylates, and benzyl (meth)acrylate. Examples of the hydrophilic monomer include acrylic acid, methacrylic acid, and maleic acid.

The dispersant preferably has an acid value of 50 mg KOH/g or more to 550 mg KOH/g or less. The dispersant preferably has a weight-average molecular weight of 1,000 or more to 50,000 or less. The mass ratio of the pigment and the dispersant (pigment:dispersant) is preferably in a range of 1:0.1 to 1:3. A so-called self-dispersible pigment that is dispersible due to surface modification of a pigment itself may also be used instead of the dispersant.

(Resin Fine Particles)

The ink used in the present exemplary embodiment can contain various fine particles with no color material. In particular, resin fine particles may have the effect of improving image quality or fixability. The material for the resin fine particles that can be used in the present exemplary embodiment is not particularly limited, and known resins can be used. The material is specifically exemplified by homopolymers such as polyolefin, polystyrene, polyurethane, polyester, polyether, polyurea, polyamide, polyvinyl alcohol, poly(meth)acrylic acid and salts thereof, polyalkyl(meth) acrylate, and polydiene, and copolymers prepared by copolymerizing a plurality of monomers, which are used for generating such a homopolymer, in combination. The resin preferably has a weight-average molecular weight (Mw) of 1,000 or more to 2,000,000 or less. In the ink, the content of the resin fine particles is preferably 1% by mass or more to 50% by mass or less and more preferably 2% by mass or more to 40% by mass or less relative to the total mass of the ink.

In addition, the resin fine particles are preferably used as a resin fine particle dispersion in which the resin fine particles are dispersed in a liquid. The dispersion technique is not particularly limited. A so-called self-dispersion type resin fine particle dispersion in which a resin prepared by homopolymerization of a monomer having a dissociable group or by copolymerization of a plurality of such monomers is dispersed is suitably used. The dissociable group used herein is exemplified by a carboxyl group, a sulfonic acid group, and a phosphoric acid group, and the monomer having such a dissociable group is exemplified by acrylic acid and methacrylic acid. In addition, a so-called emulsion-dispersion type resin fine particle dispersion in which resin fine particles are dispersed with an emulsifier can also be suitably used in the present exemplary embodiment. As the emulsifier as used herein, a known surfactant is preferable regardless of having a low molecular weight or a high molecular weight. The surfactant is preferably a nonionic surfactant or a surfactant having the same electrical charge as that of resin fine particles. The resin fine particle dispersion used in the present exemplary embodiment preferably has a dispersion particle diameter of 10 nm or more to 1,000 nm or less, and more preferably 100 nm or more to 500 nm or less.

When the resin fine particle dispersion is prepared, various additives may be added for stabilization. For example, n-hexadecane, dodecyl methacrylate, stearyl methacrylate, chlorobenzene, dodecyl mercaptan, a blue dye, and polymethyl methacrylate are preferable.

(Surfactant)

The ink that can be used in the present exemplary embodiment may contain a surfactant. The surfactant is specifically exemplified by an acetylene glycol ethylene oxide adduct (Acetylenol E100, manufactured by Kawaken Fine Chemicals Co., Ltd.). In the ink, the content of the surfactant is preferably 0.01% by mass or more to 5.0% by mass or less relative to the total mass of the ink.

(Water and Water-Soluble Organic Solvent)

The ink used in the present exemplary embodiment can contain water and/or a water-soluble organic solvent as the solvent. The water is preferably deionized water prepared by, for example, ion exchanging. In the ink, the content of the water is preferably 30% by mass or more to 97% by mass or less relative to the total mass of the ink.

The water-soluble organic solvent to be used is not limited to particular types, and any known organic solvent can be used. Specific examples of the water-soluble organic solvent include glycerol, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Needless to say, two or more solvents selected from these solvents can be used as a mixture. In the ink, the content of the water-soluble organic solvent is preferably 3% by mass or more to 70% by mass or less relative to the total mass of the ink.

(Other Additives)

The ink that can be used in the present exemplary embodiment may contain, in addition to the components described above, various additives such as a pH adjuster, an anticorrosive, an antiseptic agent, an antifungal agent, an antioxidant, a reduction inhibitor, a water-soluble resin and a neutralizer thereof, and a viscosity modifier, as needed.

<Transferability Improving Liquid>

The transferability improving liquid used in the present exemplary embodiment is a liquid that is used for the purpose of improving the transferability of an ink image onto the recording medium. The transferability improving liquid increases the adherence of the ink image to be formed on the recording medium, and does not contain any color material. As a component of the transferability improving liquid, materials other than the color materials of the ink described above can be used. The transferability improving liquid containing a water-soluble resin which functions as a binder in ink images is applied to the transfer body 101. The transferability improving liquid may be an aqueous composition or a non-aqueous composition, but contains a water-soluble resin. The term "water-soluble" used herein refers to a compound having a solubility higher than 0 g with respect to 100 g of water.

The type of the water-soluble resin contained in the transferability improving liquid is not particularly limited as long as the water-soluble resin can give an intended binder function in ink images. However, the water-soluble resin having a weight-average molecular weight of 2,000 or more and 10,000 or less is preferable. The water-soluble resin having a weight-average molecular weight of 5,000 or more and 10,000 or less is more preferable. The water-soluble resin preferably has a glass transition temperature (Tg) of 40° C. or more and 120° C. or less.

Such a water-soluble resin is specifically exemplified by block copolymers, random copolymers, and graft copolymers of at least two or more monomers (at least one of them is a hydrophilic polymerizable monomer) selected from styrene (Tg=100° C.), styrene derivatives, vinylnaphthalene (Tg=159° C.), vinylnaphthalene derivatives, aliphatic alcohol esters of α,β-ethylenically unsaturated carboxylic acids, acrylic acid, acrylic acid derivatives, maleic acid, maleic acid derivatives, itaconic acid, itaconic acid derivatives, fumaric acid, fumaric acid derivatives, vinyl acetate, vinyl alcohol, vinylpyrrolidone, acrylamide, and derivatives thereof, and salts of these copolymers. In particular, block copolymers or random copolymers of at least two or more monomers (at least one of them is a hydrophilic polymerizable monomer) selected from styrene, acrylic acid, acrylic acid derivatives, and methacrylic acid are preferable. Natural resins such as rosin, shellac, and starch can also be used. These water-soluble resins are alkali-soluble resins which are soluble in an aqueous solution in which a base is dissolved.

In the transferability improving liquid, the content of such a water-soluble resin is preferably 0.1% by mass or more and 20% by mass or less and more preferably 0.1% by mass or more and 10% by mass or less relative to the total mass of the transferability improving liquid. The transferability improving liquid preferably has a surface tension lower than the surface tension of an ink containing a color material. This enables the transferability improving liquid to spread on the transfer body 101, and the property of contacting an ink containing a color material can be improved. The transferability improving liquid preferably contains resin particles. In this case, the transferability improving liquid can contain resin particles similar to the resin particles contained in an ink containing a color material. This can prevent an ink which contains a color material and is applied onto the transfer body 101 from moving on the transfer body 101, and can improve the fastness property of an image on the recording medium. The amount of the transferability improving liquid in the ink image formed on the transfer body 101 is preferably in a range of 0.1 time to 50 times the amount of the ink applied onto the transfer body 101, and more preferably in a range of 0.5 times to 25 times the amount of the ink applied onto the transfer body 101.

<Liquid Removal Unit>

The liquid removal unit 105 removes the liquid component from the ink image formed of ink having an increased viscosity on the transfer body 101. The removal of the liquid component from the ink image by the liquid removal unit 105 enables suppression of image disturbances such as curling, cockling, and show-through effects on stacked sheets caused by a remaining liquid component contained in the ink image, after transfer of the ink image onto the recording medium 108.

The liquid removal unit 105 is provided with a halogen lamp for the removal of the solvent in the ink, which is mainly the moisture content of the ink, through evaporation or separation. The transfer characteristics of the ink image, which is an ink coagulation image formed on the transfer body 101, vary depending on the temperature. Accordingly, the amount of heat from the halogen lamp is adjusted to an amount of heat with which intended transfer characteristics are obtained. In addition to the method of drying the ink image in an accelerated manner with the halogen lamp, other devices such as an air knife, capable of controlling blow temperature and transferability of the ink image may also be employed. Any other devices capable of removing the solvent including water in the ink may also be employed. For example, a device which absorbs the solvent including water by bringing a porous body into contact with the ink image, or a device using a squeegee blade roller which squeezes the solvent including water may be employed.

<Transfer Unit>

The transfer unit 106 presses the ink image formed on the transfer body 101 against the recording medium 108, which is conveyed by the recording medium conveyance unit 107, thereby transferring the ink image onto the recording medium 108. The transfer of the ink image onto the recording medium 108 after removing the liquid component included in the ink image formed on the transfer body 101 enables acquisition of the recorded image in which curling, cockling, or the like is suppressed. As the transfer method, for example, a pressure roller is employed.

The transfer unit 106 is required to have a certain structural strength from the viewpoint of accuracy in conveying the recording medium and durability. As the material for the transfer unit 106, metals, ceramics, resins, and the like are preferably used. In particular, aluminum, iron, stainless steel, acetal resins, epoxy resins, polyimide, polyethylene, polyethylene terephthalate, nylon, polyurethane, silica ceramics, and alumina ceramics can be used in terms of the rigidity capable of withstanding the pressure at the time of transfer, dimensional accuracy, and reduction of the inertia during operation to improve the control responsivity. These materials can be used in combination.

A pressing time for pressing the ink image on the transfer body 101 against the recording medium 108 is not particularly limited, but is preferably 5 ms or more to 100 ms or less in order to satisfactorily transfer the ink image and not to deteriorate the durability of the transfer body 101. The pressing time used herein refers to a time during which the transfer body 101 and the recording medium 108 are in contact with each other. The value of the pressing time can be calculated by the following procedure. A surface pressure distribution measuring device (I-SCAN manufactured by NITTA Corporation) is used to perform surface pressure measurement, and the length in the conveyance direction of a pressured region is divided by the conveyance speed. The pressure at which the ink image on the transfer body 101 is pressed against the recording medium is not particularly limited, but is preferably 1 kg/cm$^2$ or more to 30 kg/cm$^2$ or less in order to satisfactorily transfer the ink image and not to deteriorate the durability of the transfer body 101. The pressure according to the present exemplary embodiment refers to a nip pressure between the transfer body 101 and the recording medium 108. The value of the pressure is calculated by the following procedure. The surface pressure distribution measuring device is used to perform surface pressure measurement, and a weight in a pressed region is divided by the area. As a method for controlling the pressure, the distance between the support member 102 and the pressing unit is adjusted to change the amount of compression of the transfer body 101 sandwiched between the support member 102 and the pressing unit, thereby enabling control of the pressure.

The transfer of the ink image onto the recording medium is more satisfactorily performed as the transfer pressure increases. If the transfer pressure is extremely low, residual ink remains on the transfer body 101, which may cause a so-called transfer failure. By utilizing this characteristic, the transfer pressure can be used as an index for transferability. For example, a change in transferability due to a change in transfer pressure, and a change in transferability due to a change in the application amount of the transferability improving liquid are recognized in advance through experiments or the like. Further, the transfer pressure and the application amount of the transferability improving liquid are associated with each other with respect to transferability, and the data is stored in a recording apparatus main body and thus can be used for generating transferability improving liquid data. In the case of adjusting the transfer pressure based on the distance between the support member 102 and the transfer unit 106, the distance between the support member 102 and the transfer unit 106 may be used as an index, instead of the transfer pressure. The application amount of the transferability improving liquid is not limited to that described above, and the transfer pressure and other values, such as the concentration of a resin contained in the transferability improving liquid, may be associated with each other. The temperature at which the ink image on the transfer body 101 is pressed against the recording medium is not particularly limited. An embodiment including a heating unit for heating the ink image on the transfer body, the transfer body, and the recording medium is preferable. The shape of the transfer unit 106 is not particularly limited, but is exemplified by a roller shape and a circumferential shape.

<Recording Medium and Recording Medium Conveyance Unit>

In the present exemplary embodiment, the type of the recording medium 108 is not particularly limited, and any known recording medium can be used. As the recording medium, media rolled into a roll and sheet media cut into a certain size can be used. The material is exemplified by paper, plastic films, wooden boards, corrugated cardboard, and metal films. Referring to FIG. 1, the recording medium conveyance unit 107 that conveys the recording medium includes a recording medium delivery roller 107*a* and a recording medium winding roller 107*b*. However, the configuration of the recording medium conveyance unit 107 is not limited to this configuration, as long as the recording medium conveyance unit 107 can convey the recording medium.

<Image Reading Unit>

The image reading unit 109 reads the surface of the transfer body 101 which has passed the transfer unit 106, and detects a region in which ink remains on the transfer body 101. As the reading method, an image sensor such as a charge-coupled device (CCD) or complementary metal oxide semiconductor (CMOS) can be used. If it is difficult to capture an ink image by an image sensor due to the use of a colored transfer body, the presence or absence of residual ink may be determined based on glossiness data obtained by a glossiness test apparatus using a glossmeter by utilizing a glossiness difference between a transfer body surface and an ink surface. The configuration for reading is not limited to the configuration of reading the residual ink remaining on the transfer body 101 after the transfer body 101 passes the transfer unit 106. A configuration of detecting residual ink by reading an image on a recording medium after an ink image is transferred onto the recording medium may also be used.

<Control Unit>

Figure 2:
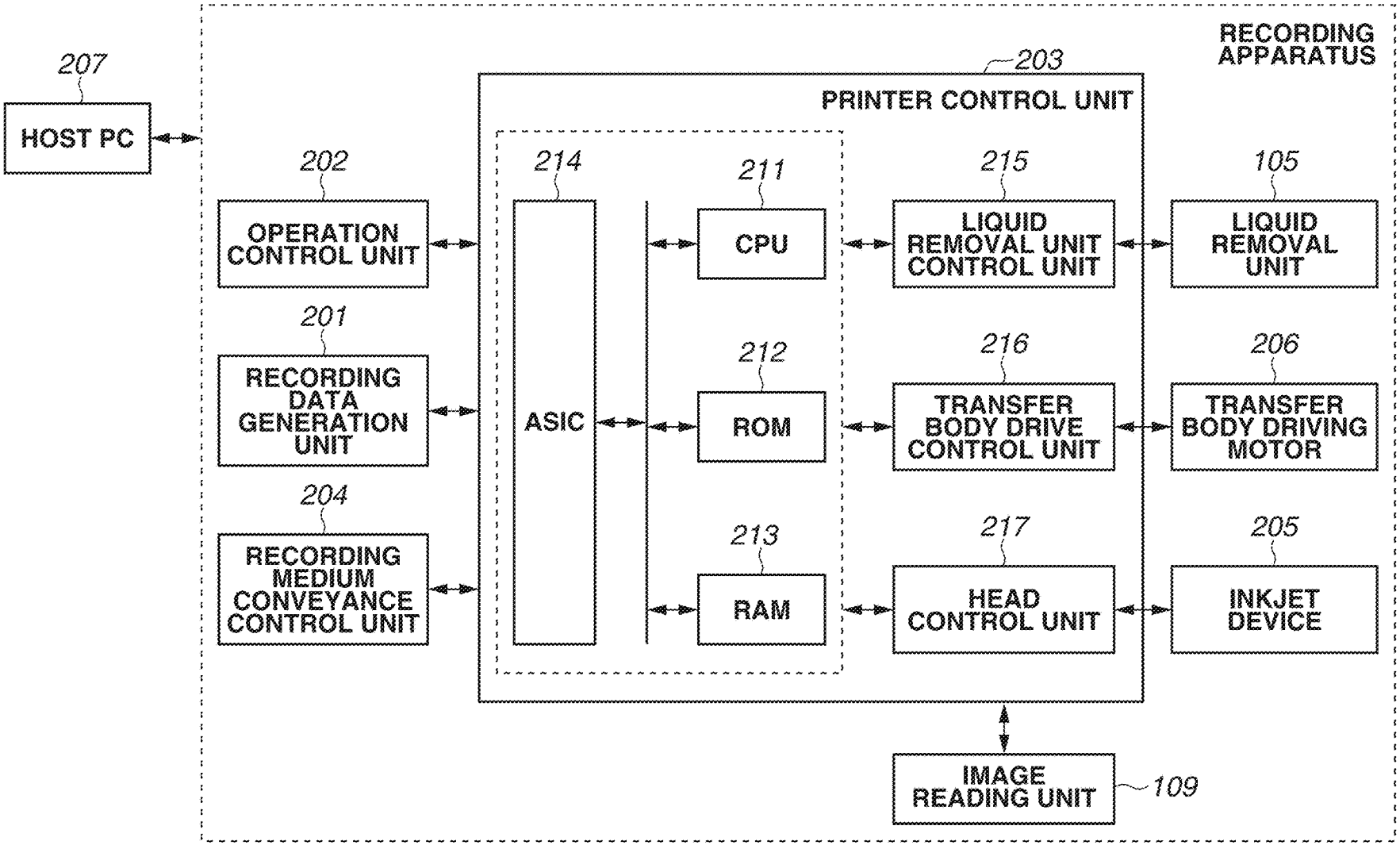
FIG. 2 is a block diagram illustrating an apparatus configuration of the transfer-type inkjet recording apparatus, according to one or more embodiment(s) of the subject disclosure.

FIG. 2 is a block diagram illustrating a control system for the entire apparatus in the transfer-type inkjet recording apparatus illustrated in FIG. 1. Referring to FIG. 2, the transfer-type inkjet recording apparatus includes a recording data generation unit 201 that performs processing illustrated in FIG. 3 described below, an operation control unit 202, such as an operation panel, the printer control unit 203 for carrying out a recording process, a recording medium conveyance control unit 204 for conveying the recording medium, an inkjet device 205 for forming an ink image on the transfer body 101 by applying ink onto the transfer body 101, a transfer body driving motor 206 for conveying the transfer body 101, and a host PC 207 that generates image data on the ink containing the color material, and the transferability improving liquid data. The generated data is transmitted to the recording data generation unit 201 via a serial interface (IF) of the recording apparatus. As described above, the liquid removal unit 105 is used to remove the liquid component included in the ink image formed on the transfer body 101, and the image reading unit 109 is used to detect residual ink on the transfer body 101 after the transfer process.

The internal configuration of the printer control unit 203 will be described in detail. The printer control unit 203 includes a central processing unit (CPU) 211 that controls the entire printer, a read only memory (ROM) 212 for storing control programs for the CPU 211, and a random access memory (RAM) 213 for executing programs. The printer control unit 203 also includes an application-specific integrated circuit (ASIC) 214 that includes, therein, a network controller, a serial IF controller, a head data generating controller, a motor controller, and the like, a liquid removal unit control unit 215 that drives the liquid removal unit 105 and is controlled by a command from the ASIC 214 via the serial IF, a transfer body drive control unit 216 that drives the transfer body driving motor 206 and is also controlled by a command from the ASIC 214 via the serial IF, and a head control unit 217 that performs generation of final discharge data on the inkjet device 205, and generation of a drive voltage, and the like. An image formed on the transfer body 101, or an image formed on the recording medium is read by the image reading unit 109, and read image data obtained after reading the image is transmitted to the recording data generation unit 201 via the ASIC 214. Further, in the recording data generation unit 201, the transferability improving liquid data is corrected based on the read image data. Processing for correcting the transferability improving liquid data will be described in detail below.

<Image Data Processing>

Figure 3:
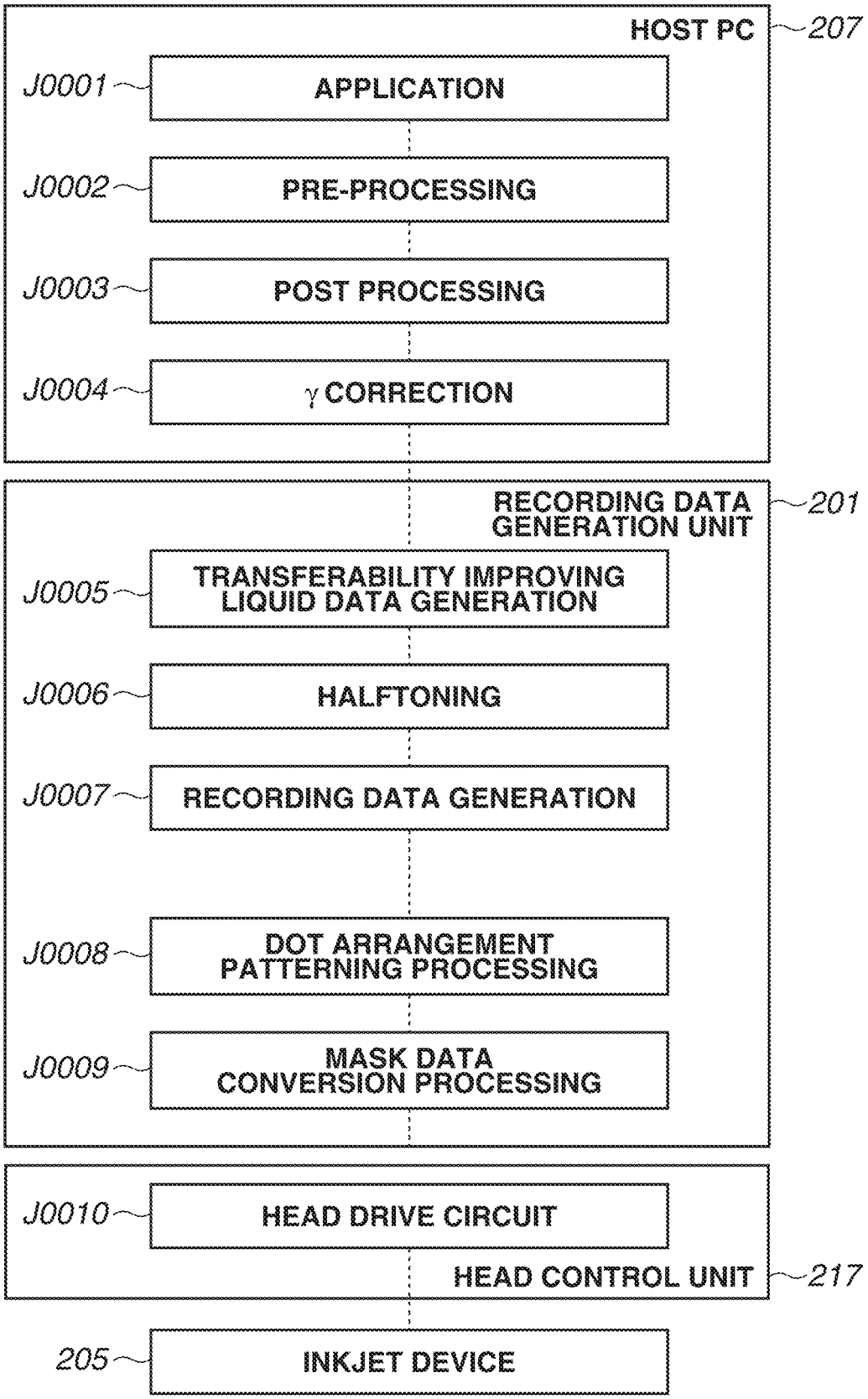
FIG. 3 is a block diagram illustrating an image data processing flow, according to one or more embodiment(s) of the subject disclosure.

FIG. 3 is a block diagram illustrating an image data processing flow in the host PC and the inkjet recording apparatus. The host PC 207 performs generation of image data representing images to be recorded, setting of a user interface (UI) for generating the data, and the like. The recording data generation unit 201 generates recording data to be recorded on the recording medium based on the image data transmitted from the host PC 207. The head control unit 217 controls the application of ink from the inkjet head based on the recording data, to thereby form an ink image on the transfer body 101.

As described above, the recording apparatus according to the present exemplary embodiment uses four colors of ink, i.e., a cyan ink (C), a magenta ink (M), a yellow ink (Y), and a black ink (K), as the ink containing color materials, and also uses a transferability improving liquid (CL) containing no color material. A number of inkjet heads for applying each of the five types of ink and liquid are provided.

An application J0001 executes processing for generating image data to be recorded in the recording apparatus. This image data, or data on which editing or the like is not performed yet, can be loaded to the host PC 207 via various media. The loaded data is subjected to editing, processing, or the like via the application J0001, and, for example, image data R, G, and B in sRGB standard are generated. On a UI screen displayed on a monitor (not illustrated) of the host PC 207, a user instructs recording after setting the type of the recording medium to be used for recording, the quality of recording, and the like. Although the method for generating the image data R, G, and B in the recording apparatus has been described above, the image data R, G, and B which are preliminarily generated can be directly input by the user.

Next, pre-processing J0002, post processing J0003, and y correction processing J0004 are sequentially executed. Each of the processing J0002 to J0004 will be described below.

In the pre-processing J0002, gamut mapping is performed. In the present exemplary embodiment, the gamut reproduced by the image data R, G, and B in sRGB standard is converted into data to be mapped in the gamut reproduced by the inkjet recording apparatus. Specifically, 256-gradation image data R, G, and B in which each of R, G, and B data is reproduced by eight bits are converted into 8-bit data R, G, and B in the gamut of the inkjet recording apparatus by using a three-dimensional look-up table (LUT).

In the post processing J0003, based on the 8-bit data R, G, and B, color separation data Y, M, C, and K respectively corresponding to the four colors of the colored ink for reproducing the colors represented by the data, and transferability improving liquid data CL corresponding to the transferability improving liquid are generated. The transferability improving liquid data CL is generated according to the values of the R, G, and B data. Also in the post processing J0003, conversion processing may be performed using an interpolation calculation while referring to a three-dimensional LUT, like in the pre-processing J0002.

In the y correction processing J0004, tone value (gradation value) conversion is performed on data on each color of color separation data obtained by the post processing J0003. Specifically, conversion processing is performed in such a manner that color separation data is linearly associated with the gradation characteristic of the recording apparatus by using a one-dimensional LUT according to the gradation characteristic of each color ink in the recording data generation unit 201.

The recording data generation unit 201 performs transferability improving liquid data generation processing J0005, halftoning J0006, recording data generation processing J0007, dot arrangement patterning processing J0008, and mask data conversion processing J0009, which are described below, on the recording data supplied from the host PC 207.

Each of the processing J0005 to J0009 will be briefly described below.

In the transferability improving liquid data generation processing J0005, the transferability improving liquid image data is generated for the original image data on which the y correction processing has been performed, by referring to the data read by the image reading unit 109 described above. Although specific processing will be described below, 8-bit transferability improving liquid data CL is corrected based on information indicating residual ink in the read image data.

In the halftoning J0006, quantization processing is performed to convert, into 4-bit data, each of the 8-bit color separation data Y, M, C, and K on which the y correction processing has been performed and the transferability improving liquid data CL on which the correction processing has been performed. In the present exemplary embodiment, 256-gradation 8-bit data is converted into 9-gradation 4-bit data by using a multi-valued error diffusion method. This 4-bit data is data used as an index indicating a dot arrangement pattern in dot arrangement patterning processing described below.

In the recording data generation processing J0007, recording data is generated by adding recording control information to recording image data including the 4-bit index data as a content.

In the halftoning J0006 described above, the number of gradation levels of 256-valued multi-valued tone information (8-bit data) is reduced to 9-valued gradation value information (4-bit data). However, data that can be actually recorded by the inkjet device 205 is binary data (1-bit data) indicating whether to discharge ink dots to each area obtained by dividing the region to which ink is applied into a plurality of areas. Accordingly, in the dot arrangement patterning processing J0008, dot arrangement patterns respectively corresponding to the gradation values (levels 0 to 8) are allocated to 4-bit data of gradation levels 0 to 8 which are output values from the halftoning J0006. In this way, 1-bit binary data indicating "1" (recording) or "0" (non-recording) is arranged in each of a plurality of areas within one pixel, and whether or not to record ink dots is defined.

Binary data of the mask pattern used in the mask data conversion processing J0009 is stored in the ROM of the recording apparatus main body. Since the inkjet head according to the present exemplary embodiment includes the plurality of recording element arrays for each type of the ink and transferability improving liquid, a plurality of pieces of binary data corresponding to the recording element arrays, respectively, is generated in the mask data conversion processing J0009. Specifically, the pieces of binary data respectively corresponding to the recording element arrays are generated for each area by performing AND processing on the binary data obtained in the dot arrangement patterning processing J0008 and on binary mask data. If the number of recording element arrays corresponding to one of the inks and the transferability improving liquid is one, there is no need to perform the processing on the recording element array, and thus the description thereof is omitted.

The generated binary data is transmitted to a head drive circuit J0010 which is provided in the head control unit 217. Consequently, the inkjet device 205 is driven to discharge the inks and the transferability improving liquid from the respective recording elements according to the binary data indicating recording or non-recording, so that an ink image is formed on the transfer body 101.

In the present exemplary embodiment, the host PC 207 is configured to execute the processing from the pre-processing J0002 to the y correction processing J0004, and the recording data generation unit 201 in the recording apparatus is configured to execute the processing from the transferability improving liquid data generation processing J0005 to the mask data conversion processing J0009. However, the configuration of the present disclosure is not limited to this configuration. For example, a part of the processing J0002 to J0004 to be executed by the host PC 207 may be executed by the recording data generation unit 201, or the entire processing may be executed by the host PC 207. Alternatively, the entire processing J0002 to J0009 may be executed by the recording data generation unit 201.

While the present exemplary embodiment illustrates the method in which the transferability improving liquid data is generated by the post processing J0003, the present disclosure is not limited to this method. The transferability improving liquid data may be input as image data (α-ch) separately from R, G, and B data. For example, the host PC 207 includes an application for generating the transferability improving liquid data separately from the application J0001 for generating the image data. The application for generating the transferability improving liquid data generates the transferability improving liquid data while referring to CMYK ink image data input to the host PC 207. The generated transferability improving liquid data may be input to the recording data generation unit 201 as α-ch.

(Transferability Improving Liquid Data Generation Processing)

The transferability improving liquid data generation processing J0005 will be described in detail. As described above, the transferability improving liquid is used to improve the adhesion force between the ink image and the recording medium during the transfer process. This is because the adhesion force between the transferability improving liquid and the recording medium is higher than the adhesion force between the ink containing the color material and the recording medium. When the contact area where the recording medium and the transferability improving liquid are in contact with each other is increased, the adhesion force between the ink image and the recording medium is increased, so that a satisfactory transferability can be obtained. To increase the contact area where the recording medium and the transferability improving liquid are in contact with each other, the application amount of the transferability improving liquid may be uniformly increased with respect to the entire surface of the ink image. However, this leads to an increase in the usage of the transferability improving liquid, resulting in an increase in running costs. Accordingly, in the present exemplary embodiment, a minimum application amount of the transferability improving liquid with which a satisfactory transferability can be obtained is determined.

Figure 4A:
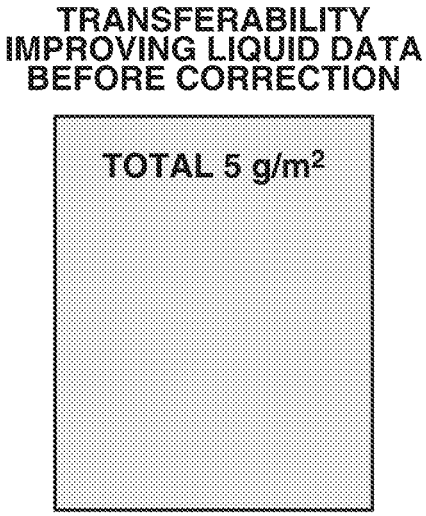
FIGS. 4A to 4C are diagrams each illustrating a method for correcting transferability improving liquid data, according to one or more embodiment(s) of the subject disclosure.
Figure 4B:
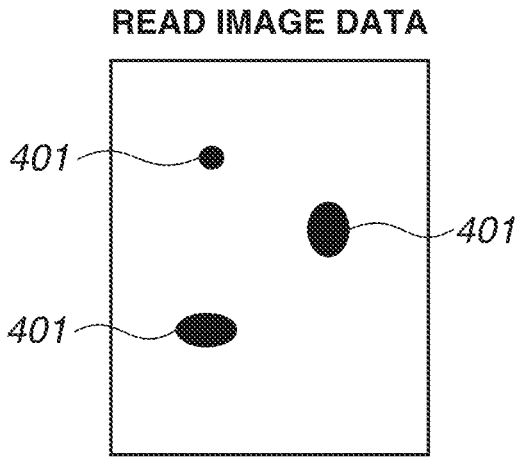
Figure 4C:
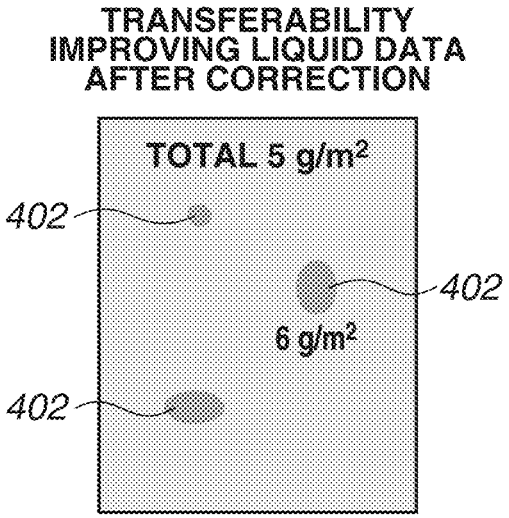

FIGS. 4A to 4C are diagrams each illustrating a method for determining the application amount of the transferability improving liquid according to the present exemplary embodiment, and each illustrate the relationship between the read image data and the transferability improving liquid data. FIG. 4A illustrates the transferability improving liquid data generated in the y correction processing J0004 described above. An example illustrated in FIG. 4A indicates that the application amount of the transferability improving liquid is 5 g/m$^2$ and the transferability improving liquid is uniformly applied onto the transfer body 101. At this time, 25 pixels (5×5 pixels) are set as a unit region at a resolution of 600 dpi×600 dpi, and the recording duty of the transferability improving liquid is 10 pixels out of 25 pixels, i.e., 40%.

FIG. 4B illustrates the read image data obtained in such a manner that the image reading unit 109 reads the surface of the transfer body 101 after the ink image is transferred onto the recording medium 108. Black regions 401 are regions which are determined to include residual ink. It is considered that, in each region which is determined to include residual ink remaining on the transfer body 101, the transferability deteriorates due to, for example, the degradation of the transfer body 101. For this reason, it is necessary to increase the application amount of the transferability improving liquid during formation of an ink image on the transfer body 101, to thereby improve the transferability.

FIG. 4C illustrates data obtained after the transferability improving liquid data illustrated in FIG. 4A is corrected. In this case, correction processing for increasing the transferability improving liquid is performed on regions 402 respectively corresponding to the regions 401 determined to include residual ink in FIG. 4B so that the amount of the transferability improving liquid is 1.2 times more than that indicated by the data generated in FIG. 4A. In the example illustrated in FIG. 4C, the transferability improving liquid data is changed so that the recording duty of 12 pixels (48%) out of 25 pixels is obtained at an application amount of 6 g/m$^2$. On the other hand, in regions including no residual ink, the transferability improving liquid data is not changed and thus the application amount of 5 g/m$^2$ is not changed.

Figure 5:
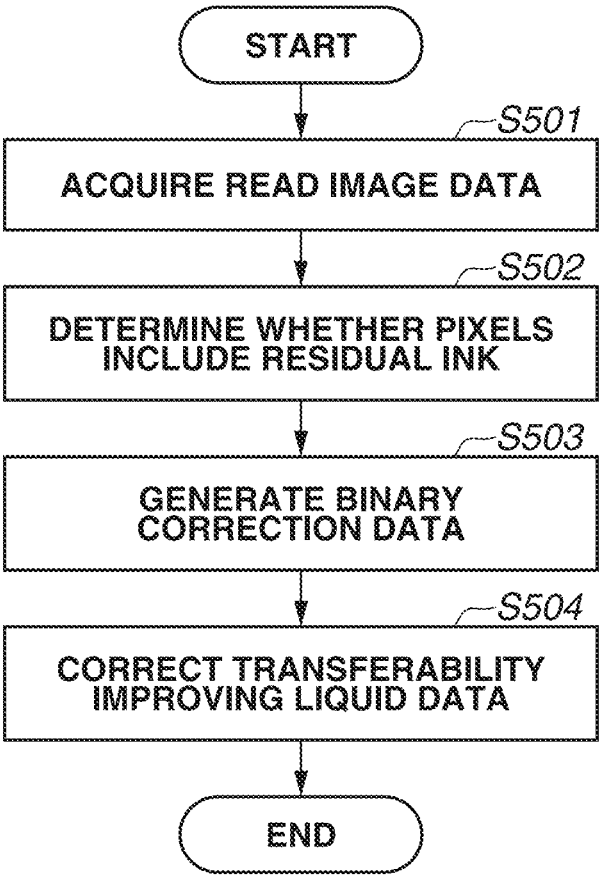
FIG. 5 is a flowchart illustrating processing for correcting the transferability improving liquid data, according to one or more embodiment(s) of the subject disclosure.

FIG. 5 is a flowchart illustrating processing for correcting the transferability improving liquid data described above with reference to FIGS. 4A to 4C. When the processing is started, first, in step S501, the recording data generation unit 201 acquires read image data for detecting the presence or absence of residual ink on the surface of the transfer body 101 that is read by the image reading unit 109. Next, in step S502, it is determined whether the pixels of the acquired read image data include residual ink, thereby detecting the region in which residual ink is present. In step S503, correction binary data indicating the presence or absence of residual ink on the transfer body 101 is generated based on the detection result obtained in step S502. This correction binary data is generated in such a manner that a pixel indicating that residual ink is present is represented by "1" and a pixel indicating that residual ink is not present is represented by "0" at a resolution of 600 dpi×600 dpi.

In step S504, the application amount of the transferability improving liquid is determined by correcting the transferability improving liquid data based on the correction binary data which indicates the presence or absence of residual ink and is generated in step S503. In the present exemplary embodiment, the transferability improving liquid data is corrected for each unit region of 25 pixels (5 pixels×5 pixels), instead of correcting the transferability improving liquid data for each pixel. Accordingly, in step S504, it is determined whether the region corresponding to the correction binary data includes a pixel represented by "1", i.e., a pixel indicating that residual ink is present on the transfer body 101, for a certain unit region in the transferability improving liquid data. When the determination result indicates that the region includes a pixel represented by "1", the transferability improving liquid data is corrected so that the application amount of the transferability improving liquid for the unit region is increased. Since the transferability improving liquid data illustrated in FIG. 4A is data indicating that the transferability improving liquid is applied to 10 pixels out of 25 pixels, the transferability improving liquid data is changed in such a manner that two pixels out of 15 pixels to which the transferability improving liquid is not applied are changed to pixels to which the transferability improving liquid is to be applied, when the application amount is increased. As a result, 12 pixels out of 25 pixels in the unit region are pixels to which the transferability improving liquid is to be applied.

The corrected transferability improving liquid data is rasterized to generate multi-valued transferability improving liquid correction data having a resolution of 600 dpi×600 dpi.

Referring again to FIG. 3, the multi-valued data for transferability improving liquid generated in the transferability improving liquid data generation processing J0005 and the multi-valued data corresponding to the ink containing four color materials are transmitted to the subsequent halftoning processing. After that, the processing of J0006 to J0009 described above is carried out and the recording operation is carried out by the inkjet device 205.

Figure 6A:
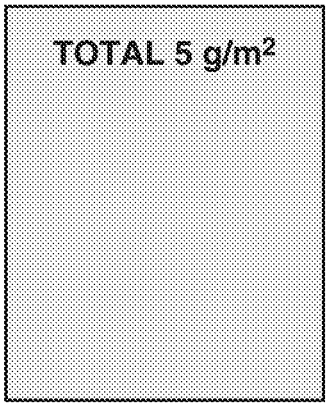
FIGS. 6A to 6D are diagrams each illustrating another example of the method for correcting the transferability improving liquid data, according to one or more embodiment(s) of the subject disclosure.
Figure 6B:
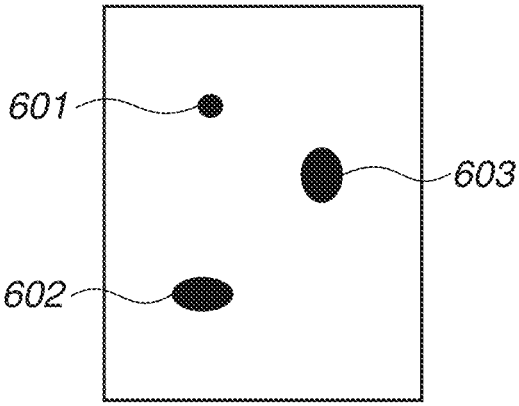
Figure 6C:
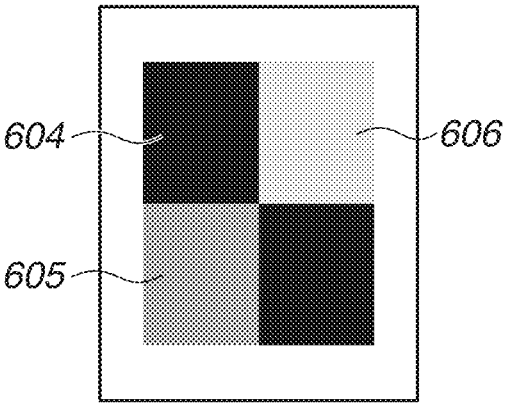
Figure 6D:
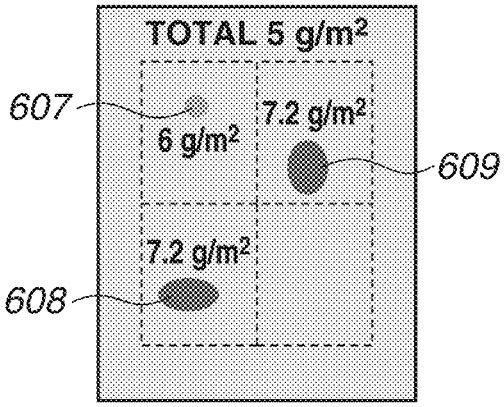
Figure 7:
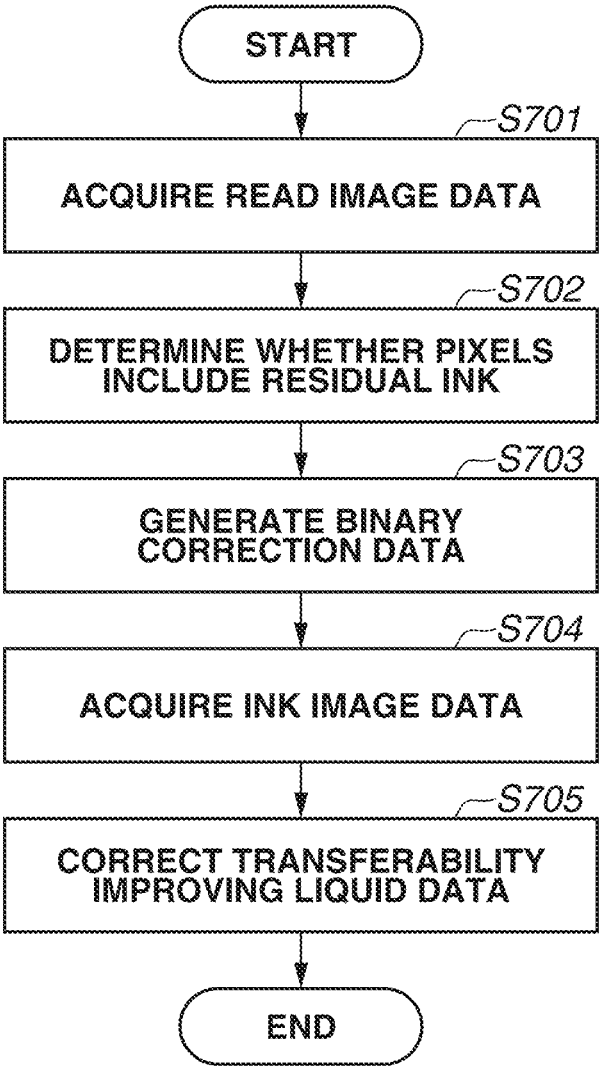
FIG. 7 is a flowchart illustrating processing for correcting the transferability improving liquid data, according to one or more embodiment(s) of the subject disclosure.

FIGS. 6A to 6D are diagrams each illustrating another example of the method for correcting the transferability improving liquid data. FIG. 7 is a flowchart illustrating the processing flow. In this example, in addition to the correction method based on the read image data described above, the application amount of the transferability improving liquid is corrected by referring to the ink data indicating the application amount of the ink containing the color materials.

Processing of steps S701 to S703 is similar to processing of steps S501 to S503 illustrated in FIG. 5, and thus descriptions thereof are omitted. FIGS. 6A and 6B are diagrams illustrating the generated transferability improving liquid data and read image data obtained by reading the surface of the transfer body 101 by the image reading unit 109, like in FIGS. 4A and 4B. The transferability improving liquid data indicates a uniform application amount of 5 g/m$^2$. Black regions 601 to 603 are regions that are determined to include residual ink in the read image data.

In step S704, multi-valued ink data which indicates the ink containing the color materials and on which the y correction processing J0004 illustrated in FIG. 3 is performed is acquired. FIG. 6C illustrates ink data on the ink containing the color materials. Regions 604 to 606 are regions with different tints, and the application amounts of the ink containing the color materials in the regions are different. The region 601 is located in the region 604. The region 602 is located in the region 605. The region 603 is located in the region 606.

In step S705, the transferability improving liquid data is corrected by referring to the correction binary data generated in step S703 and the ink image data acquired in step S704. In this example, when the unit region of the transferability improving liquid data includes a pixel indicating that residual ink is present in the region corresponding to the correction binary data, the application amount of the transferability improving liquid is increased to 6 g/m$^2$, which is a 1.2-fold increase. When one of the following two conditions is satisfied, with reference to the region corresponding to the ink data, the application amount of the transferability improving liquid is further increased to a 1.2-fold. The conditions are (1) recording is performed using any one of the C, M, and Y inks without using a K ink, and (2) the total recording duty of the C, M, Y, and K inks is equal to or less than a predetermined amount. The condition (1) is set for the following reasons. In this example, the content of the color material in the C, M, and Y color inks is greater than the content of the color material in the K ink. In the present exemplary embodiment, a pigment is used as a color material of ink, and thus the content of the color material indicates a content of a pigment. The content of resin in the color ink is the same as the content of resin in the K ink. The film strength of the ink image formed on the transfer body 101 becomes higher as the ratio of resin in the ink increases. Accordingly, the color ink in which the ratio of resin is lower than that in the K ink has a low film strength, which leads to a reduction in transferability. Therefore, when residual ink is present in the region formed only of a color ink without using a K ink, correction processing for further increasing the application amount of the transferability improving liquid is performed so as to increase the transferability. The condition (2) is set for the following reasons. The film strength of the ink image formed on the transfer body 101 becomes higher as the thickness of the film increases. Accordingly, when the application amount of ink is small, the thickness of the ink film is small, which leads to a reduction in the film strength and transferability. Therefore, when the total recording duty of the C, M, Y, and K inks to be used is equal to or less than a predetermined amount, correction processing for further increasing the application amount of the transferability improving liquid is performed so as to increase the transferability. In the present exemplary embodiment, 2 g/m$^2$ is set as a threshold.

Referring again to FIG. 6C, the region 604 is a region formed only of the K ink. The region 605 is a region formed only of the C, M, and Y color inks. The region 606 is a region in which the total recording duty of the C, M, Y, and K inks is equal to or less than a predetermined amount. FIG. 6D illustrates the corrected transferability improving liquid data. The transferability improving liquid data for a region 607 corresponding to the region 601 that is determined to include residual ink is corrected in such a manner that the transferability improving liquid is applied to 12 pixels out of 25 pixels at an application amount of 6 g/m$^2$. Similarly, the transferability improving liquid data for regions 608 and 609 is corrected in such a manner that the application amount of the transferability improving liquid for the regions 608 and 609 is set to be larger than that for the region 607 and the transferability improving liluid is applied to 14 pixels out of 25 pixels at an application amount of 7.2 g/m$^2$.

The processing for correcting the transferability improving liquid may be appropriately performed when there is an error in transfer pressure value due to the individual difference of the inkjet recording apparatus, or in consideration of a change over time caused due to a large number of recording operations. For example, in step S504 of FIG. 5, information indicating the cumulative number of pages recorded by the recording apparatus is obtained when the transferability improving liquid data is corrected. It is determined whether the cumulative number of pages exceeds a predetermined number of pages. If the cumulative number of pages exceeds the predetermined number of pages, the increasing rate of increasing the application amount of the transferability improving liquid is changed. In this case, if the cumulative number of pages exceeds 10,000 pages, the increasing rate for the region including residual ink is set to 1.4, and if the cumulative number of pages does not exceed 10,000 pages, the increasing rate for the region including residual ink remains 1.2.

As for the timing when the transferability improving liquid is increased, the transferability improving liquid may be increased every time one transfer process is performed, or every time a plurality of transfer processes is performed, or the transferability improving liquid may be increased on a job-by-job basis. When residual ink is present on the transfer body 101 after the transfer process of a certain ink image, it is preferable to correct the application amount of the transferability improving liquid in such a manner that the application amount of the transferability improving liquid is increased every time an ink image is formed, as long as the transferability improving liquid data can be corrected before an ink image is subsequently formed on the transfer body 101. It may be difficult to correct the application amount of the transferability improving liquid every time depending on the formation of the ink image and the transfer speed thereof. In this case, the transferability improving liquid data may be corrected to increase the application amount of the transferability improving liquid at a timing after a predetermined number of sheets have passed, or at a timing when the subsequent job is started.

The present exemplary embodiment illustrates a configuration in which the application amount of the transferability improving liquid for the region in which residual ink is detected is increased in consideration of running costs. However, the present disclosure is not limited to this configuration. The application amount of the transferability improving liquid can be appropriately adjusted. For example, correction processing may be performed in such a manner that the application amount of the transferability improving liquid for the region in which residual ink is detected and peripheral regions thereof is increased. Furthermore, when the number of pixels including residual ink is equal to or greater than a predetermined number, correction processing may be performed in such a manner that the application amount of the transferability improving liquid for the entire ink image is increased.

The present exemplary embodiment will be described below in more detail with reference to Examples and a Comparative Example. The present exemplary embodiment is not limited by any of the following examples without departing from the scope of the disclosure. In the following examples, "parts" are by weight unless otherwise specified.

In the following examples, the transfer-type ink jet recording apparatus illustrated in FIG. 1 is used. The transfer body 101 is fixed to the support member 102 with an adhesive. A polyethylene terephthalate (PET) sheet having a thickness of 0.5 mm coated with a silicone rubber (KE12, manufactured by Shin-Etsu Chemical Co., Ltd.) having a thickness of 0.3 mm was used as the elastic layer of a transfer body J. In addition, glycidoxypropyltriethoxysilane and methyltriethoxysilane were mixed at a molar ratio of 1:1, and the mixture was heated and refluxed to give a condensate. The condensate was mixed with a photocationic polymerization initiator (SP150 manufactured by ADEKA Corporation) to prepare a mixture. An atmospheric pressure plasma treatment was performed so that a contact angle of the elastic layer surface with water would be 10 degrees or less. Then, the mixture was applied onto the elastic layer and subjected to UV irradiation (with a high-pressure mercury lamp, an integrated exposure amount of 5,000 mJ/cm$^2$) and to thermal curing (150° C., two hours) to form a film, and a surface layer having a thickness of 0.5 μm was formed on the elastic member. As a compressive layer, nitrile foam rubber having a thickness of 1.0 mm and the PET sheet of the elastic layer were bonded to each other with an adhesive, to thereby prepare the transfer body 101 having a thickness of about 1.8 mm. Although the illustration is omitted in this configuration for simplicity of explanation, a double-sided adhesive table was used between the transfer body 101 and the support member 102 so as to hold the transfer body 101. The surface temperature of the transfer body 101 was set to 60° C. by a heating unit which is not illustrated. A reaction liquid having the following composition was used as the reaction liquid applied by the reaction liquid application unit 103, and the application amount of the reaction liquid was 1 g/m$^2$.

| | |
|---|---|
| Glutaric acid | 21.0 parts |
| Glycerin | 5.0 parts |
| Surfactant (trader name: MEGAFACE F-444, manufactured by DIC Corporation) | 5.0 parts |
| Ion-exchanged water | balance |

The ink was prepared as follows.

<Preparation of Pigment Dispersant>

After 10 parts of carbon black (trade name: Monarch 1100, manufactured by Cabot Corporation), 15 parts of a resin aqueous solution (obtained by neutralizing an aqueous solution having a resin content of 20.0% by mass of a styrene-ethyl acrylate-acrylic acid copolymer having an acid value of 150 and a weight average molecular weight of 8,000 with a potassium hydroxide aqueous solution), and 75 parts of purified water were mixed together and then charged into a batch type vertical sand mill (manufactured by Aimex Co., Ltd.), and 200 parts of zirconia beads having a diameter of 0.3 mm were further charged thereto, a dispersion treatment was performed for 5 hours while water cooling was performed. From this dispersion liquid, coarse and large particles were removed by a centrifugal operation, so that a black pigment dispersant containing 10.0% by mass of the pigment was obtained. Cyan, magenta, and yellow pigment dispersants were obtained in a manner similar to that of the black pigment dispersant, except that Pigment Blue 15, Pigment Red 7, and Pigment Yellow 74 were respectively used instead of the carbon black.

<Preparation of Resin Particle Dispersant>

A mixture of 20 parts of ethyl methacrylate, 3 parts of 2,2'-azobis-(2-methyl butyronitrile), and 2 parts of n-hexadecane was prepared and then stirred for 0.5 hours. While this mixture was dripped to 75 parts of an 8%-aqueous solution of a styrene-butyl acrylate-acrylic acid copolymer (acid value: 130 mgKOH/g, and weight-average molecular weight (Mw): 7,000), stirring was performed for 0.5 hours. Next, the mixture was irradiated with ultrasonic waves by an ultrasonic irradiation machine for 3 hours. Subsequently, a polymerization reaction was performed at 80° C. for 4 hours in a nitrogen atmosphere, and after cooling was performed at a room temperature, filtration was performed, so that a resin particle dispersant containing 25.0% by mass of resin was prepared.

<Preparation of Color Ink>

The resin particle dispersant and pigment dispersants obtained as described above were mixed with the following components. The balance of ion-exchanged water is an amount in which the sum of the constituents of the ink composition becomes 100.0% by mass.

| | |
|---|---|
| Pigment dispersant (content of color material is 10.0% by mass) | 40.0% by mass |
| Resin particle dispersant | 20.0% by mass |
| Glycerin | 7.0% by mass |
| Polyethyleneglycol (number-average molecular weight (Mn): 1,000) | 3.0% by mass |
| Surfactant: Acetylenol E100 (manufactured by Kawaken Fine Chemicals Co., Ltd.) | 0.5% by mass |
| Ion-exchanged water | balance |

After these components were sufficiently stirred, pressure filtration was performed using a microfilter (manufactured by FUJIFILM Corporation) having a pore size of 3.0 μm, so that black, cyan, magenta, and yellow inks were prepared.

<Preparation of Transferability Improving Liquid>

The resin particle dispersant obtained as described above was mixed with the following components. The balance of ion-exchanged water is an amount in which the sum of the constituents of the ink composition becomes 100.0% by mass.

| | |
|---|---|
| Polyvinylpyrrolidone ((K-15) molecular weight of 10000) | 5.0% by mass |
| Resin particle dispersant | 20.0% by mass |
| Glycerin | 7.0% by mass |
| Polyethyleneglycol (number-average molecular weight (Mn): 1,000) | 3.0% by mass |
| Surfactant: Acetylenol E100 (manufactured by Kawaken Fine Chemicals Co., Ltd.) | 0.5% by mass |
| Ion-exchanged water | balance |

After these components were sufficiently stirred for dispersion, pressure filtration was performed using a microfilter (manufactured by FUJIFILM Corporation) having a pore size of 3.0 μm, so that a transferability improving liquid was prepared.

As the ink application unit 104, an ink jet recording head including an electricity-heat transducer for discharging ink on demand was used. A gradation image with an application amount of 1 to 15 g/m$^2$ of each of black, cyan, magenta, and yellow inks was formed on the transfer body 101, and the transferability improving liquid was uniformly applied thereonto at an application amount of 5 g/m$^2$, so that an ink image was formed.

As the liquid removal unit 105, a halogen lamp manufactured by Fintech Corporation was used at a power of 200 W.

The recording medium 108 is conveyed by the recording medium delivery roller 107*a* and the recording medium winding roller 107*b* at a speed equivalent to the movement speed of the transfer body 101. In this example, the conveyance speed was 0.5 m/s, the transfer pressure was 5 kgf/cm$^2$, and Aurora Coat paper (manufactured by Nippon Paper Industries Co., Ltd., basis weight: 104 g/m$^2$) was used as the recording medium 108.

As the image reading unit 109, a scanner using a COM image sensor was used.

[Evaluation]

A residual ink on the transfer body 101 after a transfer process was performed was evaluated by the following evaluation method. Table 1 shows the evaluation results. In the present exemplary embodiment, evaluation criteria A and B in the evaluation items described below were set as preferable levels, and an evaluation criterion C was set as an unacceptable level.

<Residual Ink>

The amount of residual ink on the surface of the transfer body 101 after the transfer process was performed in the above-described conditions is shown below. It is preferable that the amount of residual ink be small. The evaluation criteria are shown below.

A: No residual ink was found;

B: A slight amount of residual ink was found, but it was negligible; and

C: A large amount of residual ink was found.

After the ink image was transferred onto the recording medium 10,000 times under the above-described conditions, the residual ink on the surface of the transfer body 101 was read by the scanner. Based on the read image, the transferability improving liquid data was corrected in such a manner that the application amount of the transferability improving liquid was set to be larger by 20% for the region including residual ink than that for the region including no residual ink. Further, a 10001st ink image was formed with the corrected application amount of the transferability improving liquid, and the residual ink on the surface of the transfer body 101 after the transfer process was performed was evaluated.

As a result, the amount of residual ink was considerably reduced. However, the adhesion of a slight amount of ink was found in the region in which the total application amount of four colors of ink was equal to or less than 2 g/m$^2$ and in the region using only color ink without using black ink.

In Example 2, the amount of the transferability improving liquid was further increased for the region in which the adhesion of ink was found even after the application amount of the transferability improving liquid was increased in Example 1, i.e., for the region in which the ink application amount was equal to or less than 2 g/m$^2$ and the region using only color ink without using black ink. Specifically, the transferability improving liquid data was corrected in such a manner that the application amount of the transferability improving liquid was set to be larger by 20% than that for the other regions including residual ink. Transfer processing was carried out in a manner similar to Example 1, and the residual ink on the surface of the transfer body 101 after the transfer process was performed was evaluated.

As a result, substantially the entire ink image was transferred from the transfer body 101 onto the recording medium without causing adhesion of a slight amount of ink which was found in Example 1.

In Example 3, the transferability improving liquid data was generated using a table of an operation distance between the support member and the pressing unit/the transferability improving liquid application amount illustrated in Table 2. An operation distance between the support member and the pressing unit in Table 2 represents a distance by which the support member and the pressing unit are moved closer to each other from the positions at which the support member and the pressing unit are located when residual ink is detected. Like in Example 1, the ink image was transferred onto the recording medium 10,000 times. The operation distance between the support member and the pressing unit in the 10,000th transfer was 1.65 mm. In the subsequent 10,001st transfer, the distance between the support member and the pressing unit was reduced by 0.05 mm and the setting of the operation distance between the support member and the pressing unit was changed to 1.60 mm, so that the transfer was carried out. As a result, the amount of residual ink in the 10,001st transfer was smaller than that in the 10,000th transfer, but residual ink was still found. In the 10,002nd transfer, the distance between the support member and the pressing unit was reduced by 0.10 mm, and the setting of the operation distance between the support member and the pressing unit was changed to 1.55 mm, so that the transfer was carried out. As a result, no residual ink was found. Referring now to Table 2, the amount of increase in the transferability improving liquid was 32% at the operation distance between the support member and the pressing unit distance of 0.10 mm. The transferability improving liquid data was generated in such a manner that the application amount of the transferability improving liquid for pixels including residual ink in the 10000th transfer was larger by 32% than in the region in which no residual ink was present, and a 10003rd image was generated and transferred. After that, residual ink on the surface of the transfer body 101 was evaluated.

As a result, adhesion of ink in the region in which the application amount of ink was small and the region using only color ink without using black ink in Example 1 was not found, and substantially the entire ink image was transferred from the transfer body 101 to the recording medium.

Example 4 illustrates a case where the present exemplary embodiment is carried out as a preparation stage before the recording is started at the time of start-up of the apparatus. In Example 4, to specify a location where it is difficult to transfer the ink, the transfer pressure was set to 3 kgf/cm$^2$ which was lower than a transfer pressure of 5 kgf/cm$^2$ during normal use. When residual ink is observed at a lower transfer pressure, a satisfactory transferability can be obtained even when the conditions are unfavorable for transfer during operation of the apparatus. The recording was carried out in a manner similar to Example 1, except that the pressure condition was changed.

First, the apparatus was operated without applying ink from the inkjet device to the transfer body 101, and warming-up of the apparatus was carried out. After that, image data was input to the apparatus, and the image was transferred onto the recording medium. A part of the image was not transferred onto the recording medium and remained as residual ink on the transfer body 101. The residual ink on the surface of the transfer body 101 after the transfer process was performed was read by the scanner. Based on the read image, image data on the transferability improving liquid was generated in such a manner that the application amount of the transferability improving liquid was set to be larger by 20% in the location where residual ink was present, than in the location where no residual ink was present. An image was formed based on the image data and transferred, and then the residual ink on the surface of the transfer body 101 was evaluated.

As a result, the amount of residual ink was considerably reduced, and substantially the entire image was transferred from the transfer body 101 to the recording medium. The recording of the image on the recording medium was started using the image data on the transferability improving liquid.

In Comparative Example 1, the application amount of the transferability improving liquid used for forming the 10,001st ink image was uniform in the entire region, like in the first to 10,000th transfer operations. Except for these conditions, the transfer process was carried out in a manner similar to Example 1, and the residual ink on the surface of the transfer body 101 after the transfer process was performed was evaluated.

As a result, the adhesion of ink was found at the location where the transfer body 101 was degraded and the releasability was decreased.

As described above in the examples, even when the transfer body 101 was degraded after the transfer body 101 was repeatedly used and residual ink was partially found, the number of times of continuously using the same transfer body 101 without causing residual ink can be increased by controlling the application amount of the transferability improving liquid.

TABLE 1

| | Evaluation Result Residual Ink |
|---|---|
| Example 1 | B |
| Example 2 | A |
| Example 3 | A |
| Example 4 | A |
| Comparative Example 1 | C |

TABLE 2

| Operation distance between the Support member and the Pressing unit (mm) | Increasing rate of transferability improving liquid (%) |
|---|---|
| 0.05 | 18 |
| 0.1 | 32 |
| 0.15 | 55 |
| 0.2 | 74 |
| 0.25 | 89 |

As for the problem that residual ink remains on the transfer body due to the degradation of the transfer body or an in-plane variation of the transfer body after the transfer process is performed, the present disclosure can solve the problem of residual ink while printing can be continuously performed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-016213, filed Jan. 31, 2017, which is hereby incorporated by reference herein in its entirety.

What is claimed is:

1. A recording apparatus comprising:

a transfer body;

an application unit configured to apply, onto the transfer body, an ink containing a color material, and a transferability improving liquid configured to increase transferability of the ink onto a recording medium by increasing an adhesion force between the ink and the recording medium;

a transfer unit configured to transfer an ink image formed on the transfer body onto the recording medium by bringing the transfer body into contact with the recording medium;

a detection unit configured to detect a region in which the ink remains on the transfer body after the transfer unit transfers the ink image onto the recording medium; and a determination unit configured to determine an amount of the transferability improving liquid to be applied to the transfer body, wherein the amount of the transferability improving liquid to be applied to the transfer body at a second transfer is based on a result of detecting an ink remaining region by the detection unit concerning ink from a first transfer remaining on the transfer body.

2. The recording apparatus according to claim 1, further comprising an acquisition unit configured to acquire transferability improving liquid data indicating a first amount of the transferability improving liquid applied to the transfer body in the first transfer, wherein, when a region in which ink remains on the transfer body after the first transfer is detected by the detection unit, the determination unit uses the acquired transferability improving liquid data to determine a second amount of the transferability improving liquid, and wherein the second amount of the transferability improving liquid is to be applied to the detected region and is larger than the first amount of the transferability improving liquid applied to the subsequently detected region.

3. The recording apparatus according to claim 2, wherein, when the detection unit outputs read image data as the detection result, the acquisition unit further acquires ink data indicating an application amount of the ink containing the color material, and the determination unit determines the application amount of the transferability improving liquid based on the read image data and the ink data.

4. The recording apparatus according to claim 3, wherein the ink containing the color material includes a black ink containing a black color material, and a color ink containing a non-black color material, and wherein the determination unit determines the application amount of the transferability improving liquid based on an application amount of the black ink and an application amount of the color ink.

5. The recording apparatus according to claim 4, wherein, when a total of the application amount of the black ink and the application amount of the color ink for the region is equal to or less than a predetermined amount, the determination unit determines the amount of the transferability improving liquid to be more than an application amount of the transferability improving liquid for the region indicated by the transferability improving liquid data.

6. The recording apparatus according to claim 4, wherein, when the region is a region to which the color ink is applied without applying the black ink, the determination unit determines the amount of the transferability improving liquid to be more than the application amount of the transferability improving liquid for the region indicated by the transferability improving liquid data.

7. The recording apparatus according to claim 4, wherein the color ink includes at least one of a cyan ink, a magenta ink, and a yellow ink.

8. The recording apparatus according to claim 2, wherein the determination unit determines the application amount of the transferability improving liquid to be more than the application amount of the transferability improving liquid indicated by the transferability improving liquid data for all regions of the transfer body.

9. The recording apparatus according to claim 1, wherein the detection unit detects the region by reading a surface of the transfer body.

10. The recording apparatus according to claim 1, wherein the detection unit detects the region by reading the recording medium onto which the ink image is transferred.

11. A method for a recording apparatus having a transfer body, the method comprising:

applying, onto the transfer body, an ink containing a color material, and a transferability improving liquid configured to increase transferability of the ink onto a recording medium by increasing an adhesion force between the ink and the recording medium;

transferring an ink image formed on the transfer body onto the recording medium by bringing the transfer body into contact with the recording medium;

detecting a region in which the ink remains on the transfer body after the transfer unit transfers the ink image onto the recording medium; and determining an amount of the transferability improving liquid to be applied to the transfer body, wherein the amount of the transferability improving liquid to be applied to the transfer body at a second transfer is based on a result of detecting an ink remaining region concerning ink from a first transfer remaining on the transfer body.

12. The recording apparatus according to claim 1, wherein, in a case where there is an initial amount of the transferability improving liquid to be applied to the transfer body by the application unit and the detection unit detects, as the region in which the ink remains on the transfer body, a region of residual ink on the transfer body, the determination unit determines that an amount of the transferability improving liquid to be applied in the region of residual ink is to be greater than the initial amount.

13. The recording apparatus according to claim 1, wherein the transferability improving liquid is configured to cause an adhesion force between the ink image and the recording medium to be greater than in a case where the ink image does not include the transferability improving liquid.

14. The recording apparatus according to claim 1, wherein the transferability improving liquid is configured to cause an adhesion force between the transferability improving liquid and the recording medium that is higher than an adhesion force between the ink image without the transferability improving liquid and the recording medium.

15. The recording apparatus according to claim 1, wherein the transferability improving liquid is configured such that, as a contact area where the transferability improving liquid and the recording medium are in contact with each other is increased, an adhesion force between the ink image and the recording medium is increased, thereby increasing transferability to a predetermined amount.

16. The recording apparatus according to claim 1, wherein the amount of the transferability improving liquid with respect to the entire surface of the ink image varies the transfer body.

17. The recording apparatus according to claim 16, wherein, as the amount of the transferability improving liquid varies over the transfer body, the varying amount of the transferability improving liquid is no greater than a predetermined minimum amount.

18. The recording apparatus according to claim 1, wherein the amount of the transferability improving liquid is uniformly distributed over the transfer body.

19. The recording apparatus according to claim 1, wherein the recording apparatus is a transfer-type inkjet recording apparatus, and the transferability improving liquid includes polyvinylpyrrolidone in a quantity configured to increase an adhesion force between the ink and the recording medium to a predetermine amount.

* * * * *